United States Patent [19]

Martinet

[11] 4,023,343

[45] May 17, 1977

[54] ELECTRONIC CLOCK WITH CAPACITATIVE RESETTING

[76] Inventor: René G. Martinet, 81 Avenue Bosquet, Paris, France, 75007

[22] Filed: Apr. 23, 1976

[21] Appl. No.: 679,863

[30] Foreign Application Priority Data

Apr. 25, 1975 France ..... 75.13056

[52] U.S. Cl. ..... 58/23 R; 200/DIG. 1; 58/85.5

[51] Int. Cl.² ..... G04C 3/00

[58] Field of Search ..... 200/DIG. 1; 58/50 R, 58/85.5, 23 R

[56] References Cited

UNITED STATES PATENTS

| | | | |
|---|---|---|---|
| 3,541,779 | 11/1970 | Langley | 58/50 R |
| 3,742,699 | 7/1973 | Bergey | 58/50 R |
| 3,762,152 | 10/1973 | Marz | 58/23 R |
| 3,940,920 | 3/1976 | Nakamura et al. | 58/50 R X |
| 3,983,690 | 10/1976 | McClintock | 58/23 R X |

*Primary Examiner*—Ulysses Weldon

[57] ABSTRACT

A reset system for a digital electronic clock of the multistage counter type. Means are provided for deriving from the mains alternating current timing pulses at a frequency substantially higher than 1 Hz and a frequency divider chain derives from these timing pulses, resetting pulses at a frequency higher than 1 Hz and stepping on pulses for the seconds counter at a frequency of 1 Hz. The timing pulses are converted into gating signals by capacitative keys and resettable monostable circuits. The resetting pulses are applied to the counters through AND-gates controlled by the resettable monostable circuits and through OR-gates, the latter receiving also the pulses for stepping on the counters.

5 Claims, 3 Drawing Figures

ELECTRONIC CLOCK WITH CAPACITATIVE RESETTING

BACKGROUND OF THE INVENTION

This invention relates to an electronic clock comprising counters and a digital display panel, the clock operating from 50 or 60 Hz a.c. mains, more particularly to an electronic clock of the kind described in which resetting is by means of capacitative keys or the like and requires no moving member such as an actuating button.

PRIOR ART

Electronic clocks are known wherein counters and displays devices are cascade-connected and are respectively associated with the seconds, tens of seconds, minutes, tens of minutes, hours and tens of hours. The counters act both as counters and frequency dividers - i.e. they produce a tripping pulse upon reaching a count of 10 in the case of the seconds, minutes and hours counters and when they reach a count of 6 in the case of the counters associated with the tens of seconds and with the tens of minutes. Every counter except the first is supplied with stepping-on pulses of a recurrence frequency equal to the time unit with such counter is associated by the tripping of the previous counter. The first counter is supplied with stepping-on pulses which have a frequency of 1 Hz and which are produced by a timing pulse generator comprising a shaping circuit, such as a Schmitt trigger, and a frequency-divider chain, the shaping circuit receiving the 50 or 60 Hz mains a.c. of a 100 or 120 Hz signal resulting from full-wave rectification of the mains a.c. Consequently, the total division factor of the frequency-divider chain is 50 or 60 or 100 or 120, depending on the a.c. signal applied to the timing pulse generator.

It is also known to reset such electronic clocks by substituting at the input of each counter associated with a particular time unit a higher-frequency signal derived from the frequency-divider chain of the timing pulse generator. The substitution is performed by means of switching means. For instance, if the applied a.c. signal is at a frequency of 100 Hz and if the frequency-divider chain has two dividers by 5 giving a 4 Hz signal and one divider by 4 giving a 1 Hz signal, switching means are provided to substitute the 4 Hz signal for the 1 Hz signal at the input of whichever of the six counters of the electronic clock it is required to reset.

U.S. Pat. No. 3,762,152 issued Oct. 2, 1973 discloses a system for resetting an electronic clock as just outlined; in this prior art, resetting device the switching means are push-buttons and the seconds stage is adapted to be disconnected from the incoming 1 Hz stepping-on pulses when the resetting pulses are applied to some other stage, so that the latter stage does not receive simultaneously stepping-on pulses from the previous stage and resetting pulses.

OBJECTS OF THE INVENTION

The main object of this invention is to provide an electronic clock comprising counters and a digital display panel and devoid of any moving member, in which clock the resetting device is controlled by capacitative keys flush with the clock casing and which just have to be touched with the finger for an appropriate time to reset the clock.

It is another object of the invention to provide a low-cost electronic clock having counters and a digital display panel in which, instead of fast resetting pulses being substituted for the normal slow stepping-on pulses of the counters at the input thereof, the resetting pulses are superimposed on the stepping-on pulses by arranging for the stepping-on pulses to coincide with some of the resetting pulses. Consequently, the counting pulses are "dissolved" in the resetting pulses. It therefore becomes possible for the switches of the prior art electronic clocks to be replaced by simple OR-gates, the resetting operation involving merely producing or not producing resetting pulses in a circuit permanently connected to the OR-gates.

SUMMARY OF THE INVENTION

According to the invention, the electronic clock comprises a decade seconds counter, a sexenary tens-of-seconds counter, a decade minutes counter, a sexenary tens-of-minutes counter, an hours counter which can be selectively of the decade or quaternary kind and a tens-of-hours counter, all the counters being cascade-connected and, except for the seconds counter, receiving as stepping-on pulses the carry pulses of the previous counter; means for deriving from the mains a.c. timing pulses at a repetition frequency higher than 1 Hz; a frequency-divider chain receiving the timing pulses and supplying resetting pulses at a frequency greater than or equal to 1 Hz and pulses for stepping-on the seconds counter at the frequency of 1 Hz; means for selectively applying the stepping-on pulses and the resetting pulses to the counters and capacitative resetting control keys or the like, characterized in that the means for selectively applying the stepping-on pulses and the resetting pulses comprises transistors whose input circuits contain the capacitative resetting keys; resettable monostables in the output circuits of the transistors; AND-gates receiving the resetting pulses and the output signals of the resettable monostables; and OR-gates disposed between the counters and receiving the stepping-on pulses of the counter and the output pulses of the AND-gates.

The resetting pulses must be synchronous with the stepping-on pulses since the counters receive both kinds of pulse during resetting and must ignore the stepping-on pulses. The same must therefore coincide with resetting pulses.

BRIEF DESCRIPTION OF THE DRAWINGS

The invention will now be described in detail with reference to an embodiment shown in the accompanying drawings wherein.

DETAILED DESCRIPTION

Figure 1:
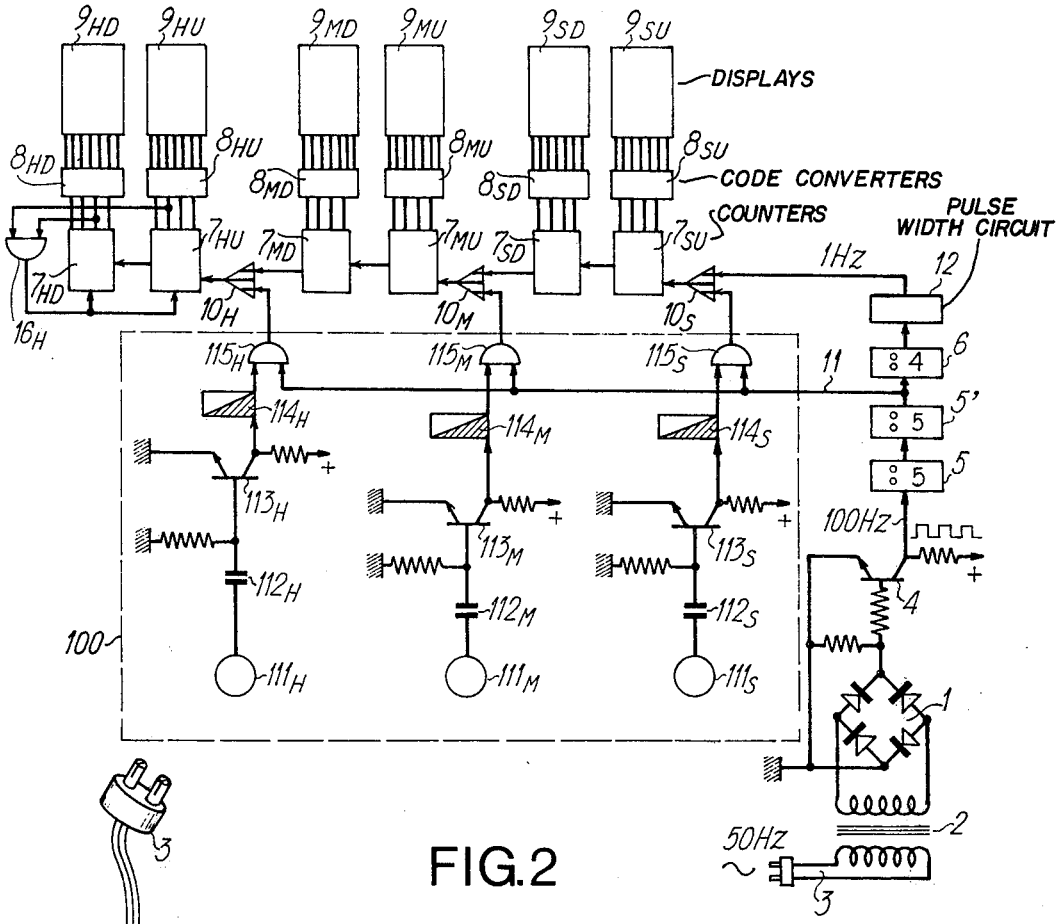
FIG. 1 is a view, partly in the form of a block diagram, of the electronic scheme of the clock according to the invention.

Referring to FIG. 1, an electronic clock according to the invention comprises a rectifier bridge 1 whose input is connected to an a.c. supply by a voltage-reducing circuit 2, such as a transformer or a voltage divider, and a flexible lead 3, and a pulse-shaping transistor 4. A Schmitt trigger could be used instead of transistor 4. 100 Hz timing pulses obtained at the output of transistor 4 are applied to a frequency-divider chain providing a total division of 100 and embodied e.g. by three cascaded binary counters 5, 5', 6 counting up to 5, 5 and 4 respectively. 4 Hz pulses are available at the output of counter 5'. If the timing pulses were at the frequency of 120 Hz, counter 5 would count to 6, counter 5' to 5 and counter 6 to 4. 1 Hz pulses are available at the output of counter 6.

The 1 Hz pulses are the pulses for stepping-on a seconds counter $7_{SU}$ and are applied thereto via OR-gate $10_S$. The 4 Hz pulses are the resetting pulses and are applied to line 11 and thereby to OR-gates $10_S$, $10_M$, $10_H$ and to resetting circuit 100. The seconds counter $7_{SU}$ is a decade counter counting from 0 to 9 and the tens-of-seconds counter $7_{SD}$ is a sexenary counter counting from 0 to 5. Counter $7_{SD}$ therefore outputs one pulse a minute. The pulses from counter $7_{SD}$ are applied to the input of counter $7_{MU}$ via OR-gate $10_M$. The minutes units counter $7_{MU}$ is a decade counter counting from 0 to 9 and the tens-of-minutes counter $7_{MD}$ is a sexenary counter counting from 0 to 5. Counter $7_{MD}$ therefore outputs one pulse an hour. The pulses from counter $7_{MD}$ go to the input of counter $7_{HU}$ via OR-gate $10_H$. The hours units counter $7_{HU}$ is a decade counter counting from 0 to 9 and the tens-of-hours counter $7_{HD}$ is a tertiary counter counting from 0 to 2. By way of appropriate connections, counters $7_{HU}$ and $7_{HD}$ can be reset to zero when counter $7_{HD}$ is at 2 and when counter $7_{HU}$ is going to change from 3 to 4 - i.e. the system comprising $7_{HD}+7_{HU}$ changes from 23 to 00 and not from 23 to 24. Of course, matters could be so arranged that counter $7_{HD}$ counts only to 1 and so that the system $7_{HD}+7_{HU}$ changes from 11 to 00 and not from 11 to 12 to correspond to the habits of countries where the day is divided not into 24 hours but into two periods of 12 hours. Gate $16_H$ is for the changeover from 23 to 00.

Each counter 7 is embodied by four binary bistables, and so the four outputs of each counter represent a decimal digit in binary decimal code. The outputs of each counter are connected to a respective transcoder or code converter $8_{SU}$, $8_{SD}$, $8_{MU}$, $8_{MD}$, $8_{HU}$, $8_{HD}$ each having four inputs and seven outputs; the seven outputs of each transcoder are connected to a respective light display facility $9_{SU}$, $9_{SD}$, $9_{MU}$, $9_{MD}$, $9_{HU}$, $9_{HD}$ each having seven segments. The transcoder acts in known manner to convert the four-bit words representing the decimal digit into seven-bit words enabling the decimal digits to be displayed in stylized form in seven straight segments. The contents of the hours counters $7_{HD}$, $7_{HU}$, of the minutes counters $7_{MD}$, $7_{MU}$ and of the seconds counters $7_{SD}$, $7_{SU}$ can therefore be displayed.

If the OR-gates $10_S$, $10_M$, $10_H$ are disregarded and are assumed to be replaced by switches connecting the input of counters $7_{SU}$, $7_{MU}$, $7_{HU}$ either to the output of counters 6, $7_{SD}$, $7_{MD}$ respectively or the line 11 respectively, the resulting clock has a resetting system which is completely prior art.

Resetting system 100 uses three stationary conductive capacitative keys or the like $111_S$, $111_M$, $111_H$ placed on the clock casing; the seconds or minutes or hours are reset by the keys being touched with the finger. The keys have an area of the same order of magnitude as the end of the finger, say, from 0.4 to 2 $cm^2$. Each key is a conductive contact connected via a capacitor $112_S$, $112_M$, $112_H$ to the vase of the transistor $113_S$, $113_M$, $113_H$ respectively. When a finger is applied to the key, the base of the transistor receives a 50 Hz signal which comes from the signal induced capacitatively in the user's body by the mains current supplying the clock.

It is found by experience that when a finger is present on a key $111_S$ or $111_M$ or $111_H$, rectangular signals at a frequency of 50 Hz – or 100 Hz in the case of full-wave automation - appear at the collectors of transistors $113_S$ or $113_M$ or $113_H$ respectively and are applied to the input of a resettable monostable $114_S$ or $114_M$ or $114_H$ respectively. The flip-flopping (changeover) time of the monostable is greater than the time between two driving signal pulses, say more than 20 ms or more than 10 ms in the case of fullwave rectification. Consequently, the monostable $114_S$ or $114_M$ or $114_H$ does not return to zero for as long as a finger remains on the capacitative key $111_S$ or $111_M$ or $111_H$.

The signal delivered at output Q of monostable $114_S$ is applied to one input of the two-input AND-gate $115_S$. The other input thereof receives the signal from the output of the 4 Hz counter 5', and so AND-gate $115_S$ outputs 4 Hz pulses for a long as the finger remains on key $111_S$. The output of AND-gate $115_S$ is connected to the input of OR-gate $10_S$ receiving the 1 Hz pulses from the output of counter 6. Consequently, OR-gate $10_S$ outputs either 1 Hz pulses if the resetting key $111_S$ is not operated or 4 Hz pulses if the key $111_S$ is operated.

Rapid resetting of minutes and hours is by means of hour-resetting devices which are identical to seconds-resetting devices and comprise a respective key $111_M$, $111_H$, a capacitor $112_M$, $112_H$, the transistor $113_M$, $113_H$, the monostable $114_M$, $114_H$ and an AND-gate $115_M$, $115_H$ having its output connected respectively to the input of OR-gate $10_M$, $10_H$ for resetting the hours of the two pairs of counters $7_{MU}$, $7_{MD}$ and $7_{HU}$, $7_{HD}$.

When a counter, e.g. the minutes counter $7_{MD}$, is reset, if the number to be displayed is smaller than the number already on display the counter $7_{MD}$ changes over from the digit 5 to the digit 0 at a particular instant of time and a carryover pulse is applied to the hours units counter $7_{HU}$ which advances wrongly one unit. The minutes must therefore be reset before the hours.

The flip-flopping time of the monostables $114_S$, $114_M$, $114_H$ must not be much longer than the time between two 50 Hz or 100 Hz pulses, as appropriate, to ensure that the action of the monostables ceases substantially immediately the capacitative key ceases to be operated.

As hereinbefore explained, when any stage of the clock is resetted, the normal stepping-on or drive pulses continues to be applied to the various counters, and unless the latter pulses are to introduce irregularities into resetting, they must coincide in time with some of the resetting pulses. Some counters produce square signals whose pulse width is equal to half their period. If such a counter is used as the counter 6, the width of the 1 Hz pulses is 500 ms and the width of the 4 Hz pulses is 125 ms. Drive pulse width must therefore be reduced from 500 ms to 125 ms, preferably 100 ms, and the centre-points of the 1 and 4 Hz pulses must be brought into coincidence. This purpose is served by a synchronizing and pulse width circuit 12. The same comprises in known manner a first monostable triggered by the leading edge of the stepping-on pulses, and a second monostable triggered by the trailing edge of the output signal of the first monostable. The first monostable synchronizes the 1 and 4 Hz pulses and the second monostable adjusts the width or duration of the 1 Hz pulses.

Figure 2:
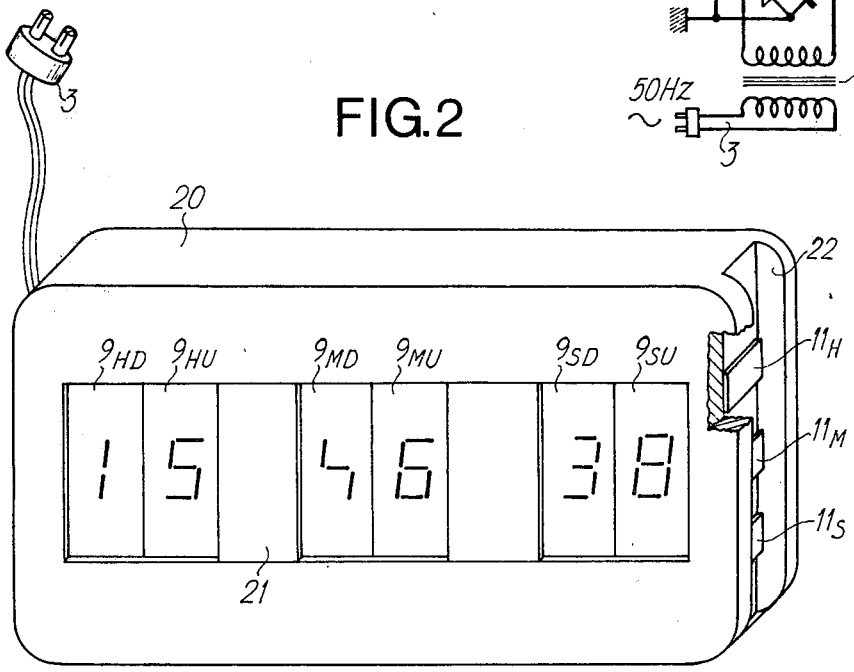
FIG. 2 is a perspective view of the clock with its casing.

Referring now to FIG. 2, the electronic clock has a casing 20 formed with a window 21 through which the seven segment digit displayers or the like $9_{SU}$, $9_{SD}$, $9_{MU}$, $9_{MD}$, $9_{HU}$, $9_{HD}$ appear at the front surface of the casing. One of the side surfaces is formed with a groove 22; flush with the surface thereof are three flat metal members $111_S$, $111_M$, $111_H$ which serve as capacitative keys and which can be e.g. metal inserts in a plastics casing. The capacitative keys are disposed at the bottom of a groove so that inadvertent manipulation of the clock does not cause accidental resetting. The operator must introduce his finger in a groove to reset the clock.

Figure 3:
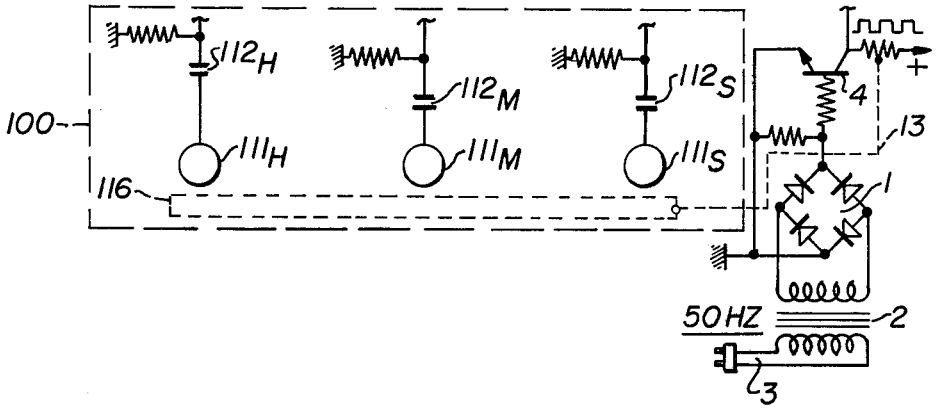
FIG. 3 is a fragmentary view of FIG. 1 showing a modification of the invention.

It has been assumed in the foregoing that the capacitative resetting keys are floating from the d.c. point of view and that when the operator touches them the timing pulses are applied to them by an antenna effect. It is found by experience that this provides satisfactory operation but disturbances may arise if any metal items are very close to the clock. For improved reliability of operation a main key 116 connected by a line 13, as shown in FIG. 3, to the timing pulse generator is placed near the keys $111_S$, $111_M$, $111_H$. The operator therefore straddles the resetting key and the main key with his finger.

What I claim is:

1. An electronic clock comprising a decade seconds counter, a sexenary tens-of-seconds counter, a decade minutes counter, a sexenary tens-of-minutes counter, an hours counter and a tens-of-hours counter, all the counters being cascade-connected and, except for the seconds counter, receiving as stepping-on pulses the carry pulses of the previous counter, means for deriving from a frequency source timing pulses at a repetition frequency higher than 1 Hz, a frequency-divider chain receiving the timing pulses and supplying resetting pulses at a lower frequency than said frequency source and the seconds counter coupled to said frequency divider chain to receive pulses at the frequency of 1 Hz, capacitative resetting control keys, transistors having input circuits respectively containing capacitative resetting keys and output circuits, resettable monostable circuits in the output circuits of said transistors, AND-gates receiving the resetting pulses and the output signals of said resettable monostable circuits and OR-gates disposed between the counters and receving the stepping-on pulses of the counter and the output pulses of the AND-gates.

2. An electronic clock according to claim 1, further comprising a synchronizing and pulse adjusting circuit coupled to said frequency-divider chain for synchronizing the stepping-on pulses with the resetting pulses and making the width of the stepping-on pulses equal to or less than the width of the resetting pulses.

3. An electronic clock according to claim 1, further comprising a main control key near the capacitative resetting control keys and means for applying to the main key the resetting pulses delivered by the frequency-divider chain.

4. An electronic clock according to claim 1, further comprising a casing and in which the capacitative keys are flush with the casing surface and are disposed in the base of a groove in such surface.

5. An electronic clock according to claim 4, in which the casing is made of plastics and capacitative keys are metal members inserted into the casing during the moulding thereof.

* * * * *